US009966014B2

(12) United States Patent
Yashiki

(10) Patent No.: US 9,966,014 B2
(45) Date of Patent: May 8, 2018

(54) FIELD SEQUENTIAL LIQUID CRYSTAL DISPLAY DEVICE AND METHOD OF DRIVING SAME

(71) Applicant: Sharp Kabushiki Kaisha, Osaka-shi, Osaka (JP)

(72) Inventor: Masafumi Yashiki, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 175 days.

(21) Appl. No.: 15/031,303

(22) PCT Filed: Sep. 4, 2014

(86) PCT No.: PCT/JP2014/073284
§ 371 (c)(1),
(2) Date: Apr. 22, 2016

(87) PCT Pub. No.: WO2015/072213
PCT Pub. Date: May 21, 2015

(65) Prior Publication Data

US 2016/0322004 A1 Nov. 3, 2016

(30) Foreign Application Priority Data

Nov. 13, 2013 (JP) ..... 2013-234938

(51) Int. Cl.
*G09G 3/34* (2006.01)
*G09G 5/02* (2006.01)
*G09G 3/36* (2006.01)

(52) U.S. Cl.
CPC ..... *G09G 3/3413* (2013.01); *G09G 3/3426* (2013.01); *G09G 3/3674* (2013.01);
(Continued)

(58) Field of Classification Search
CPC ..... G09G 2310/0235; G09G 3/3413; G09G 2300/0452
See application file for complete search history.

(56) References Cited

U.S. PATENT DOCUMENTS 6,115,016 A * 9/2000 Yoshihara ..... G09G 3/3413 345/102
2002/0057253 A1* 5/2002 Lim ..... G09G 3/3611 345/102

(Continued)

FOREIGN PATENT DOCUMENTS

JP 2004-341206 A 12/2004
JP 2007-206698 A 8/2007

(Continued)

OTHER PUBLICATIONS

Official Communication issued in International Patent Application No. PCT/JP2014/073284, dated Dec. 9, 2014.

*Primary Examiner* — Priyank Shah
(74) *Attorney, Agent, or Firm* — Keating & Bennett, LLP

(57) ABSTRACT

A field sequential processing unit 11 includes a representative value calculating unit 111 configured to obtain a representative value for each pixel based on video data Ri, Gi, and Bi, a backlight data generating unit 112 configured to generate backlight data Xb indicating brightness of LEDs 18 in each area of the backlight 17 based on the obtained representative value, a video data correcting unit 113 configured to correct the video data Ri, Gi, and Bi based on the backlight data Xb, and a field data generating unit 114 configured to generate four pieces of field data Wf, Rf, Gf, and Bf based on the corrected video data Rc, Gc, Bc. By generating the backlight data based on the representative value for each pixel, it is possible to reduce a size of a circuit for obtaining brightness of the backlight for each area.

10 Claims, 14 Drawing Sheets

(52) U.S. Cl.
CPC ..... *G09G 3/3685* (2013.01); *G09G 5/026* (2013.01); *G09G 2300/0452* (2013.01); *G09G 2310/0235* (2013.01); *G09G 2310/08* (2013.01); *G09G 2320/0242* (2013.01); *G09G 2320/0247* (2013.01); *G09G 2320/0261* (2013.01); *G09G 2320/0266* (2013.01); *G09G 2320/0646* (2013.01); *G09G 2330/021* (2013.01); *G09G 2330/023* (2013.01); *G09G 2340/0435* (2013.01)

(56) References Cited

U.S. PATENT DOCUMENTS

| | | | | |
|---|---|---|---|---|
| 2004/0227456 | A1 | 11/2004 | Matsui | |
| 2007/0176943 | A1 | 8/2007 | Cho | |
| 2007/0200807 | A1* | 8/2007 | Lee | G09G 3/3413 345/88 |
| 2007/0222743 | A1* | 9/2007 | Hirakata | G09G 3/3413 345/102 |
| 2008/0297676 | A1* | 12/2008 | Kimura | G02F 1/13624 349/39 |
| 2010/0265281 | A1 | 10/2010 | Furukawa et al. | |

FOREIGN PATENT DOCUMENTS

| | | | |
|---|---|---|---|
| JP | 2010-250061 | A | 11/2010 |
| JP | 5152084 | B2 | 2/2013 |

* cited by examiner

FIELD SEQUENTIAL LIQUID CRYSTAL DISPLAY DEVICE AND METHOD OF DRIVING SAME

TECHNICAL FIELD

The present invention relates to a liquid crystal display device, in particular, to a field sequential type liquid crystal display device, and a method of driving such a liquid crystal display device.

BACKGROUND ART

Liquid crystal display devices are widely used as image display devices for displaying color images. Many conventional liquid crystal display devices display color images using color filters. Further, field sequential type liquid crystal display devices are known as a liquid crystal display device for displaying color images without using color filters.

Typically, a field sequential type liquid crystal display device is provided with a backlight including light sources of red, green, and blue, and displays three fields of red, green, and blue in one frame period. When the red field is to be displayed, a liquid crystal panel is driven based on red video data, and the red light source emits light. Then, the green field and the blue field are displayed in a similar manner. The three fields displayed by time division are combined based on an afterimage effect on an observer's retina, and thus would be recognized as a single color image by the observer.

In the field sequential type liquid crystal display device, the observer often sees colors of these three fields separated when a line of sight of the observer moves within a display screen. This phenomenon is called as a color breakup. Displaying a white field in addition to red, green, and blue fields is conventionally known as a method of reducing color breakup. Aside from this, controlling brightness of the backlight for each area according to video data is known as a method of reducing power consumption of liquid crystal display devices.

Patent Document 1 describes an image display device that controls brightness of a backlight for each area, and displays white, red, green, and blue fields (see FIG. 15). The image display device shown in FIG. 15 performs resolution reduction processing to input video signals Rorg, Gorg, and Borg to obtain light emission patterns BLr, BLg, and BLb of the backlight for each partial light emitting area. Then, the image display device generates partial driving video signals R, G, and B by dividing the input video signals Rorg, Gorg, and Borg by results obtained when diffusion processing is applied to the light emission patterns BLr, BLg, and BLb, and extracts a common white component Wcom from the partial driving video signals R, G, and B. Patent Document 2 describes a field sequential video display device that resolves one frame of a video signal into a plurality of fields, the number of the fields being greater than the number of colors of single color light sources.

PRIOR ART DOCUMENTS

Patent Documents

[Patent Document 1] Japanese Patent No. 5152084

[Patent Document 2] Japanese Laid-Open Patent Publication No. 2007-206698

SUMMARY OF THE INVENTION

Problems to be Solved by the Invention

However, for each partial light emitting area of the backlight, the image display device described in Patent Document 1 separately obtains the light emission pattern BLr for the red field, the light emission pattern BLg for the green field, and the light emission pattern BLg for the blue field. Therefore, the image display device has a problem that a circuit for obtaining brightness of a backlight for each area is large in size.

Thus, an object of the present invention is to provide a field sequential type liquid crystal display device that controls brightness of a backlight for each area, the display device having a circuit with a reduced size for obtaining the brightness of the backlight for each area.

Means for Solving the Problems

According to a first aspect of the present invention, there is provided a field sequential type liquid crystal display device including: a liquid crystal panel having a plurality of pixels arranged two-dimensionally; a backlight including a plurality of types of light sources having different emission colors, each of the types including a plurality of light sources; a field sequential processing unit configured to generate, based on video data including a plurality of pieces of color component data, a plurality of pieces of field data used for driving the liquid crystal panel, and backlight data used for controlling the backlight; a panel drive circuit configured to drive the liquid crystal panel based on the field data corresponding to a color of a field in each field period; and a backlight control circuit configured to control, based on the backlight data, one or more types of light sources corresponding to the color of the field to be in a light-emitting state in each field period, wherein the field sequential processing unit includes: a representative value calculating unit configured to obtain a representative value for each pixel based on the video data; a backlight data generating unit configured to generate backlight data based on the representative value obtained by the representative value calculating unit, the backlight data indicating brightness of light sources in each of a plurality of areas obtained by dividing the backlight; a video data correcting unit configured to correct the video data based on the backlight data; and a field data generating unit configured to generate a plurality of pieces of field data based on the corrected video data obtained by the video data correcting unit, a number of the pieces of field data being greater than a number of the types of light sources.

According to a second aspect of the present invention, in the first aspect of the present invention, the representative value calculating unit obtains a maximum value of the plurality of pieces of color component data as the representative value for each pixel.

According to a third aspect of the present invention, in the first aspect of the present invention, the representative value calculating unit obtains an average value of the plurality of pieces of color component data as the representative value for each pixel.

According to a fourth aspect of the present invention, in the first aspect of the present invention, the backlight includes a plurality of red light sources, a plurality of green light sources, and a plurality of blue light sources, the video data includes red video data, green video data, and blue video data, and the field data generating unit generates pieces of red, green, and blue field data, and pieces of field data for one or more colors selected from white, cyan, yellow, and magenta, based on corrected red video data, corrected green video data, and corrected blue video data obtained by the video data correcting unit.

According to a fifth aspect of the present invention, in the fourth aspect of the present invention, the field data generating unit generates the white, red, green, and blue field data.

According to a sixth aspect of the present invention, in the fourth aspect of the present invention, the field data generating unit generates the white, cyan, yellow, magenta, red, green, and blue field data.

According to a seventh aspect of the present invention, in the fourth aspect of the present invention, the field data generating unit generates the red, green, and blue field data, and field data for one color selected from cyan, yellow, and magenta.

According to an eighth aspect of the present invention, in the first aspect of the present invention, input video data input from outside is supplied as the video data to the field sequential processing unit.

According to a ninth aspect of the present invention, in the first aspect of the present invention, the liquid crystal display device further includes: a frame rate converting unit configured to perform frame rate conversion processing to input video data input from outside, wherein, to the field sequential processing unit, video data after conversion output from the frame rate converting unit is supplied as the video data.

According to a tenth aspect of the present invention, in the ninth aspect of the present invention, the frame rate converting unit doubles a frame rate of the input video data.

According to an eleventh aspect of the present invention, in the ninth aspect of the present invention, when the video data for two frames is supplied, the representative value calculating unit obtains the representative value for each pixel based on the video data for one frame, the backlight data generating unit generates the backlight data based on the representative value for one frame, the video data correcting unit corrects the video data for two frames based on the backlight data, and the field data generating unit generates the plurality of pieces of field data based on the corrected video data for two frames obtained by the video data correcting unit.

According to a twelfth aspect of the present invention, in the eleventh aspect of the present invention, a frame rate of the input video data is 60 Hz, the frame rate converting unit converts the frame rate of the input video data to 144 Hz, and the field data generating unit generates four pieces of field data based on the corrected video data for two frames obtained by the video data correcting unit.

According to a thirteenth aspect of the present invention, there is provided a method of driving a field sequential type liquid crystal display device including a liquid crystal panel having a plurality of pixels arranged two-dimensionally and a backlight including a plurality of types of light sources having different emission colors, each of the types including a plurality of light sources, the method including: a step of obtaining a representative value for each pixel based on the video data including a plurality of pieces of color component data; a step of obtaining backlight data based on the representative value, the backlight data indicating brightness of light sources in each of a plurality of areas obtained by dividing the backlight; a step of correcting the video data based on the backlight data; a step of generating a plurality of pieces of field data based on the corrected video data, a number of the pieces of field data being greater than a number of the types of light sources; a step of driving the liquid crystal panel based on the field data corresponding to a color of a field in each field period; and a step of controlling, based on the backlight data, one or more types of light sources corresponding to the color of the field to be in a light-emitting state in each field period.

Effects of the Invention

According to the first or thirteenth aspect of the present invention, in a field sequential type liquid crystal display device that controls brightness of a backlight for each area according to video data, the backlight data is generated based on the representative value for each pixel of the video data. Therefore, as compared to a case in which a plurality of pieces of backlight data are separately generated based on a plurality of pieces of color component data, it is possible to reduce an amount of calculation for obtaining brightness of the backlight for each area, and thus to reduce a size of the circuit for obtaining brightness of the backlight for each area.

According to the second aspect of the present invention, by obtaining the maximum value of the plurality of pieces of color component data as the representative value for each pixel of the video data, and by generating the backlight data based on the obtained maximum value, it is possible to reduce a size of the circuit for obtaining brightness of the backlight for each area.

According to the third aspect of the present invention, by obtaining the average value of the plurality of pieces of color component data as the representative value for each pixel of the video data, and by generating the backlight data based on the obtained average value, it is possible to reduce a size of the circuit for obtaining brightness of the backlight for each area.

According to the fourth aspect of the present invention, by displaying field(s) for one or more colors selected from the white, cyan, yellow, and magenta in addition to the red, green, and blue fields, it is possible to display two or more colors out of red, green, and blue using a plurality of fields, and thus to reduce color breakup.

According to the fifth aspect of the present invention, by displaying the white field in addition to the red, green, and blue fields, it is possible to display each of red, green, and blue using two fields, and thus to reduce color breakup.

According to the sixth aspect of the present invention, by displaying the white, cyan, yellow, and magenta fields in addition to the red, green, and blue fields, it is possible to display each of red, green, and blue using four fields, and thus to reduce color breakup.

According to the seventh aspect of the present invention, by displaying any of the cyan, yellow, and magenta fields in addition to the red, green, and blue fields, it is possible to display two colors out of red, green, and blue using two fields, and thus to reduce color breakup.

According to the eighth aspect of the present invention, in a field sequential type liquid crystal display device that controls brightness of a backlight for each area according to input video data, by generating the backlight data based on the representative value for each pixel of the input video data, it is possible to reduce a size of the circuit for obtaining brightness of the backlight for each area.

According to the ninth aspect of the present invention, in a field sequential type liquid crystal display device that controls brightness of a backlight for each area according to video data after frame rate conversion, by generating the backlight data based on the representative value for each pixel of the video data after frame rate conversion, it is possible to reduce a size of the circuit for obtaining brightness of the backlight for each area. Further, by performing frame rate conversion processing to the input video data, it is possible to correct the display positions in the fields, and to reduce color breakup.

According to the tenth aspect of the present invention, a frame rate converting unit may be easily configured.

According to the eleventh aspect of the present invention, by displaying a plurality of fields corresponding to one frame period based on the video data after frame rate conversion for two frames, as compared to the case in which a plurality of fields corresponding to one frame period based on the video data after frame rate conversion for one frame are displayed, it is possible to lower a drive frequency of liquid crystals, and to configure the liquid crystal display device more easily or at reduced costs.

According to the twelfth aspect of the present invention, by setting a frame rate of a display screen to be 72 Hz, and a drive frequency of liquid crystals to be 288 Hz, it is possible to reduce flicker from occurring in a display screen using a practical liquid crystal panel with reduced costs.

MODES FOR CARRYING OUT THE INVENTION

First Embodiment

Figure 1:
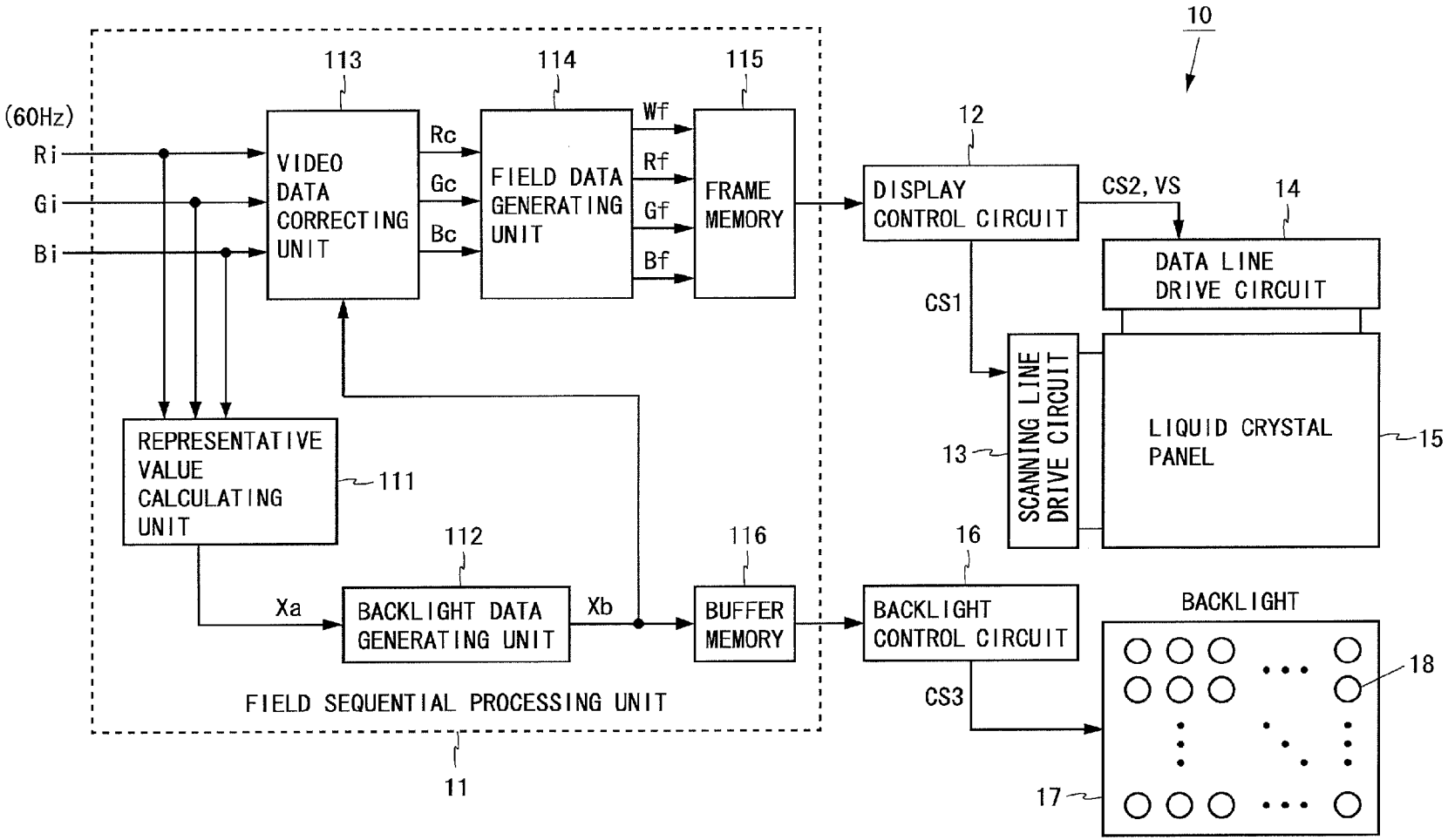
FIG. 1 is a block diagram illustrating a configuration of a liquid crystal display device according to a first embodiment of the present invention.

FIG. 1 is a block diagram illustrating a configuration of a liquid crystal display device according to a first embodiment of the present invention. A liquid crystal display device 10 shown in FIG. 1 includes a field sequential processing unit 11, a display control circuit 12, a scanning line drive circuit 13, a data line drive circuit 14, a liquid crystal panel 15, a backlight control circuit 16, and a backlight 17. The liquid crystal display device 10 displays four fields (white, red, green, and blue fields) in one frame period by performing field sequential driving. Further, the liquid crystal display device 10 controls brightness of the backlight 17 for each area according to input video data. Hereinafter, it is assumed that m and n are integers equal to or greater than 2, p and q are integers equal to or greater than 1, all satisfying relations of $p<m$ and $q<n$.

The liquid crystal panel 15 includes a plurality of pixels that are arranged two-dimensionally. More specifically, the liquid crystal panel 15 includes m scanning lines (not shown), n data lines (not shown), and (m×n) pixels (not shown). The m scanning lines extend in a horizontal direction (traverse direction in FIG. 1) of a display screen, and arranged in parallel with each other. The n data lines extend in a vertical direction (longitudinal direction in FIG. 1) of the display screen, and arranged perpendicular to the m scanning lines and in parallel with each other. The (m×n) pixels are disposed respectively at intersections between the m scanning lines and the n data lines.

The display control circuit 12 outputs a control signal CS1 to the scanning line drive circuit 13, and a control signal CS2 and a video signal VS to the data line drive circuit 14. The scanning line drive circuit 13 sequentially selects the m scanning lines based on the control signal CS1. The data line drive circuit 14 applies voltages corresponding to the video signal VS to the n data lines based on the control signal CS2.

Figure 2:
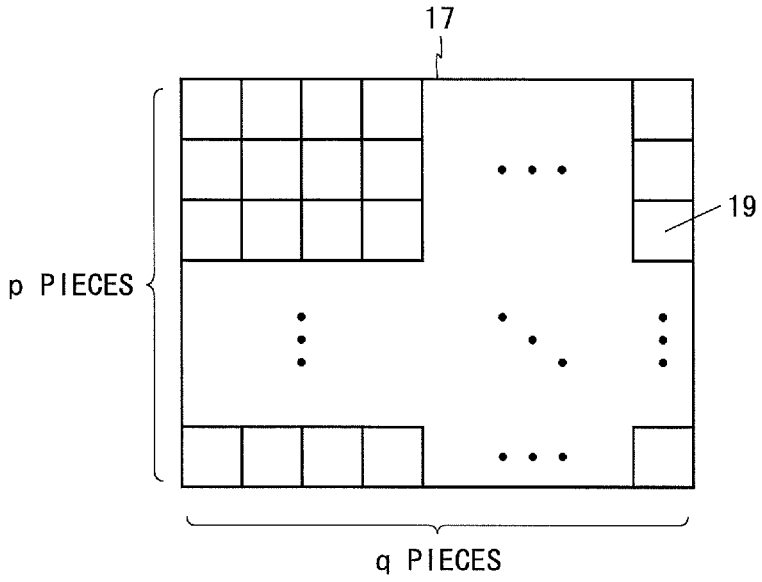
FIG. 2 is a diagram illustrating area division of a backlight of the liquid crystal display device shown in FIG. 1.

The backlight 17 includes a plurality of types of light sources having different emission colors (red, green, and blue light sources), each of the types including a plurality of light sources. More specifically, the backlight 17 is a direct-type backlight including a plurality of LEDs (Light Emitting Diodes) 18 that are arranged two-dimensionally. The plurality of LEDs 18 includes red LEDs, green LEDs, and blue LEDs. As illustrated in FIG. 2, the backlight 17 is divided into a total of (p×q) areas 19 including p areas along the vertical direction (longitudinal direction in FIG. 2) of the display screen, and q areas along the horizontal direction (traverse direction in FIG. 2) of the display screen. The liquid crystal panel 15 is also divided into (p×q) areas. Each of the areas 19 includes at least one red LED, one green LED, and one blue LED. Each of the areas 19 may include only one red LED, one green LED, and one blue LED. The backlight control circuit 16 outputs a control signal CS3 to the backlight 17. The control signal CS3 indicates brightness of the LEDs 18 in each of the areas 19. The LEDs 18 in each of the areas 19 emit light at the same brightness according to the control signal CS3.

To the liquid crystal display device 10, input video data including data for three color components (red video data Ri, green video data Gi, and blue video data Bi) is input from outside. Hereinafter, a frame rate of the input video data is assumed to be 60 Hz. While the three pieces of video data Ri, Gi, and Bi are input separately in FIG. 1, the three pieces of video data Ri, Gi, and Bi may be input in a mixed manner. The input video data is supplied to the field sequential processing unit 11.

The field sequential processing unit 11 includes a representative value calculating unit 111, a backlight data generating unit 112, a video data correcting unit 113, a field data generating unit 114, a frame memory 115, and a buffer memory 116. The representative value calculating unit 111 obtains a representative value for each pixel in the liquid crystal panel 15 based on the input video data. The representative value calculating unit 111 may obtain a maximum value of the red video data Ri, the green video data Gi, and the blue video data Bi as the representative value for each pixel, for example. Alternatively, the representative value calculating unit 111 may obtain an average value (simple average value or weighted average value) of the red video data Ri, the green video data Gi, and the blue video data Bi, as the representative value for each pixel. The representative value calculating unit 111 outputs representative value data Xa indicating the representative value for each pixel. The number of pieces of data included in the representative value data Xa for one frame is equal to the number of pixels of the liquid crystal panel 15, which is (m×n).

The backlight data generating unit 112 obtains brightness of the LEDs 18 in each of the areas 19 of the backlight 17, based on the representative value data Xa. The backlight data generating unit 112 may obtain an average value of the representative values for the pixels for each of the areas 19, and then obtain the brightness of the LEDs 18 in each of the areas 19 based on the obtained average value, for example. Alternatively, the backlight data generating unit 112 may obtain a maximum value of the representative values for the pixels for each of the areas 19, and then obtain the brightness of the LEDs 18 in each of the areas 19 based on the obtained maximum value. The backlight data generating unit 112 outputs the backlight data Xb indicating the brightness of the LEDs 18 in each of the areas 19 of the backlight 17. The number of pieces of data included in the backlight data Xb for one frame is equal to the number of the areas 19, which is (p×q). The backlight data Xb is stored in the buffer memory 116, and supplied to the video data correcting unit 113.

The video data correcting unit 113 corrects the input video data based on the backlight data Xb. The video data correcting unit 113 obtains brightness of the backlight 17 at a position of each pixel of the liquid crystal panel 15 based on the backlight data Xb, for example, and corrects the three pieces of video data Ri, Gi, and Bi by dividing brightness of each pixel by the brightness of the backlight 17 at the position of this pixel. The video data correcting unit 113 outputs corrected red video data Rc, corrected green video data Gc, and corrected blue video data Bc as the corrected video data.

Based on the three pieces of corrected video data Rc, Gc, and Bc, the field data generating unit 114 generates four pieces of field data (white field data Wf, red field data Rf, green field data Gf, and blue field data Bf), the number of pieces of field data being greater than the number of types of the light sources included in the backlight 17. For example, the field data generating unit 114 performs calculation for each pixel of the liquid crystal panel 15 as shown by the following equations (1) to (4). Here, min represents calculation for obtaining a minimum value.

$$Wf=\min(Rc,Gc,Bc) \tag{1}$$

$$Rf=Rc-Wf \tag{2}$$

$$Gf=Gc-Wf \tag{3}$$

$$Bf=Bc-Wf \tag{4}$$

Figure 3:
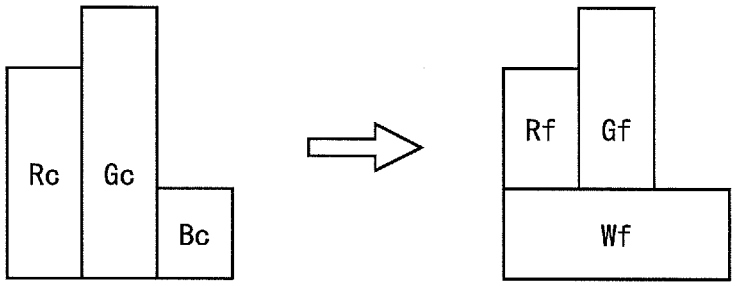
FIG. 3 is a diagram illustrating an example of processing by a field data generating unit of the liquid crystal display device shown in FIG. 1.

FIG. 3 is a diagram illustrating an example of processing by the field data generating unit 114. In FIG. 3, three rectangles shown on a left side of an arrow represent the pieces of corrected video data, and three rectangles shown on a right side of the arrow represent the pieces of field data. In the example shown in FIG. 3, a relation of Bc<Rc<Gc is established. In this case, Wf=Bc, Rf=Rc−Bc, Gf=Gc−Bc, and Bf=0, based on the equations (1) to (4).

The four pieces of field data Wf, Rf, Gf, and Bf generated by the field data generating unit 114 are stored in the frame memory 115. The display control circuit 12 sequentially reads the four pieces of field data Wf, Rf, Gf, and Bf stored in the frame memory 115. The backlight control circuit 16 reads the backlight data Xb stored in the buffer memory 116. The liquid crystal panel 15 is driven based on the four pieces of field data Wf, Rf, Gf, and Bf, and the backlight 17 is controlled based on the backlight data Xb.

Figure 4:
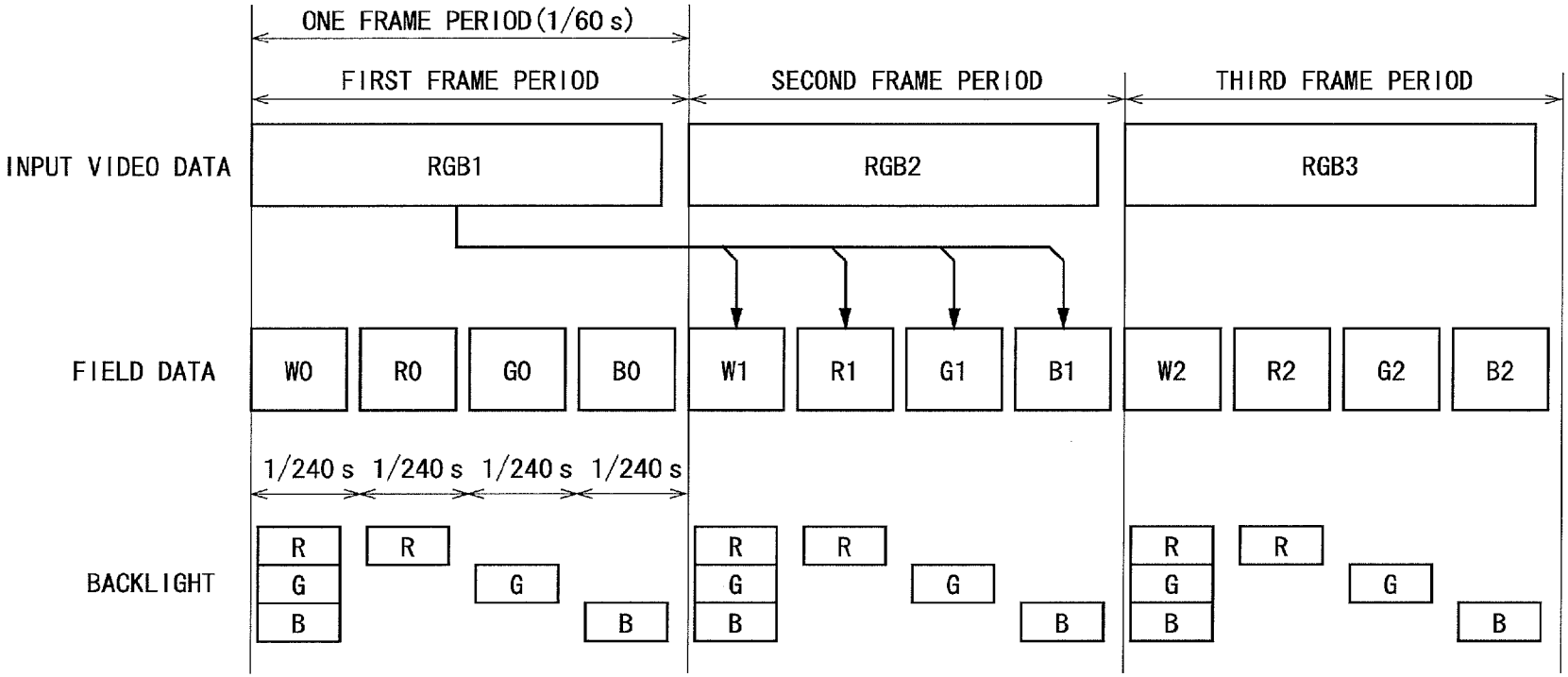
FIG. 4 is a timing chart of the liquid crystal display device shown in FIG. 1.

FIG. 4 is a timing chart of the liquid crystal display device 10. In the liquid crystal display device 10, one frame period is divided into four field periods (white, red, green, and blue field periods). In the first frame period, video data RGB1 for a first frame is input to the liquid crystal display device 10. The field sequential processing unit 11 generates backlight data X1 and four pieces of field data W1, R1, G1, and B1 based on the video data RGB1 for the first frame. The backlight data X1 is stored in the buffer memory 116, and the four pieces of field data W1, R1, G1, and B1 are stored in the frame memory 115.

In the second frame period, the display control circuit 12 sequentially reads the four pieces of field data W1, R1, G1, and B1 from the frame memory 115, and outputs the video signal VS including the pieces of read field data to the data line drive circuit 14. In the white, red, green, and blue field periods, the scanning line drive circuit 13 and the data line drive circuit 14 drive the liquid crystal panel 15 based on the white, red, green, and blue field data W1, R1, G1, and B1, respectively.

In the second frame period, the backlight control circuit 16 reads the backlight data X1 from the buffer memory 116. In each field period, the backlight control circuit 16 controls one or three types of LEDs corresponding to a color of a field to be in a light-emitting state. Specifically, the backlight control circuit 16 controls the red, green, and blue LEDs to be in the light-emitting state in the white field period, and controls corresponding one of the red, green, and blue LEDs to be in the light-emitting state in each of the red, green, and blue field periods. In any of these field periods, the backlight control circuit 16 controls the LEDs 18 in each of the areas 19 to emit light with brightness corresponding to the backlight data X1.

As described above, based on the input video data, the field sequential processing unit 11 generates the four pieces of field data Wf, Rf, Gf, and Bf used for driving the liquid crystal panel 15, and the backlight data Xb used for controlling the backlight 17. The display control circuit 12, the scanning line drive circuit 13, and the data line drive circuit 14 function as a panel drive circuit that drives the liquid crystal panel 15 based on the field data corresponding to the color of the field in each field period. The backlight control circuit 16 controls one or more types of light sources to be in the light-emitting state, based on the backlight data Xb in each filed period.

According to the liquid crystal display device 10 of this embodiment, it is possible to display a color image by displaying the white, red, green, and blue fields in one frame period. Further, by displaying the white field in addition to the red, green, and blue fields, it is possible to display each of red, green, and blue using two fields, and thus to reduce color breakup. Moreover, by controlling brightness of the backlight 17 for each area according to the input video data, it is possible to reduce power consumption of the backlight 17, and to reduce power consumption of the liquid crystal display device 10.

Figure 5:
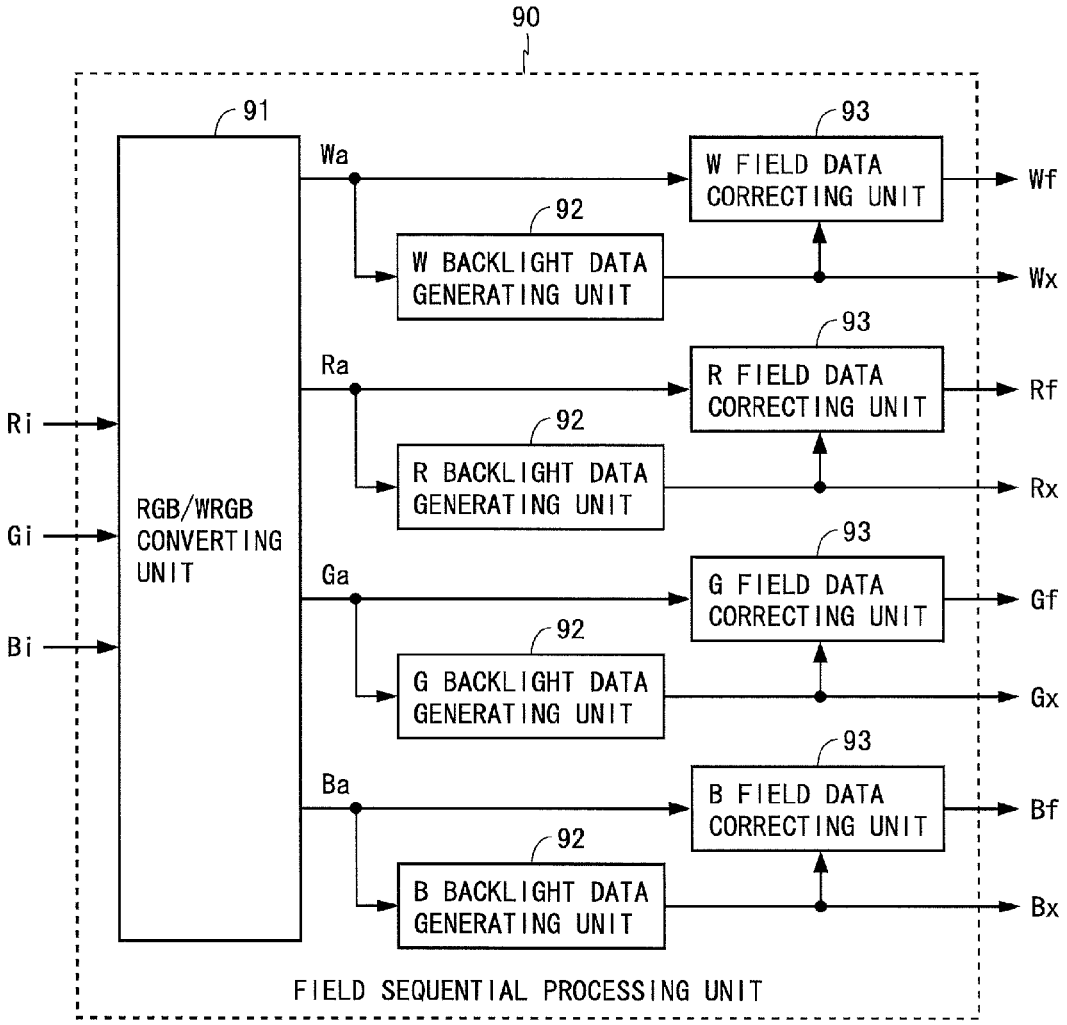
FIG. 5 is a block diagram illustrating a configuration of a field sequential processing unit of a liquid crystal display device according to a comparative example.

Hereinafter, specific effects of the liquid crystal display device 10 will be described. Here, a field sequential type liquid crystal display device that controls brightness of backlight for each area and displays white, red, green, and blue fields is considered. Such a liquid crystal display device may be configured using a field sequential processing unit 90 shown in FIG. 5, for example. In FIG. 5, an RGB/WRGB converting unit 91 converts the three pieces of video data Ri, Gi, and Bi into four pieces of field data Wa, Ra, Ga, and Ba. Four backlight data generating units 92 respectively generate backlight data Wx, Rx, Gx, and Bx indicating brightness of the backlight for each area based on the four pieces of field data Wa, Ra, Ga, and Ba. Four field data correcting units 93 respectively correct the field data Wa, Ra, Ga, and Ba based on the backlight data Wx, Rx, Gx, and Bx, and output the corrected field data Wf, Rf, Gf, and Bf. The field sequential processing unit 90 generates the backlight data and corrects the field data after adding a white field. Accordingly, in the field sequential processing unit 90, it is necessary to obtain brightness of the backlight for each area separately for the white, red, green, and blue fields. Therefore, a liquid crystal display device having the field sequential processing unit 90 has a problem that a circuit for obtaining brightness of the backlight for each area is large in size.

Figure 15:
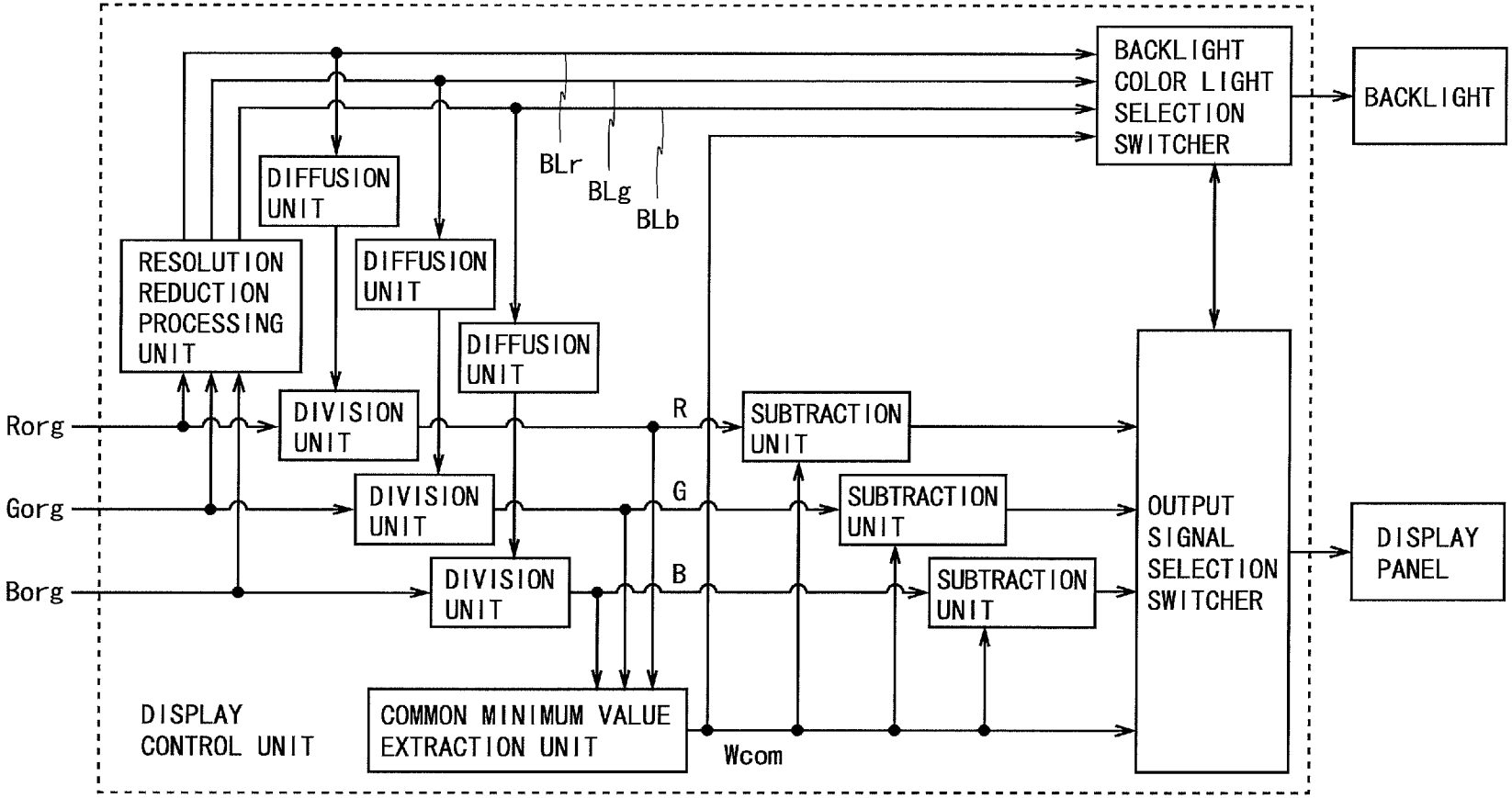
FIG. 15 is a block diagram illustrating a configuration of a conventional liquid crystal display device.

The image display device described in Patent Document 1 (FIG. 15) adds a white field after generating the backlight data and correcting the video data. Accordingly, in this image display device, it is not necessary to obtain brightness of the backlight for the white field. However, this image display device obtains brightness of the backlight for each area separately for the red, green, and blue fields. Therefore, this image display device also has the problem that a circuit for obtaining brightness of the backlight for each area is large in size.

On the other hand, the field sequential processing unit 11 of the liquid crystal display device 10 according to this embodiment includes the representative value calculating unit 111 that obtains a representative value for each pixel based on the input video data, the backlight data generating unit 112 that generates the backlight data Xb based on the representative value obtained by the representative value calculating unit 111, the video data correcting unit 113 that corrects the input video data based on the backlight data Xb, and the field data generating unit 114 that generates the four pieces of field data Wf, Rf, Gf, and Bf based on the corrected input video data obtained by the video data correcting unit 113. The field sequential processing unit 11 generates the backlight data Xb based on the representative value obtained for each pixel of the input video data, generates the backlight data Xb, corrects the input video data, and then adds a white field.

As described above, the liquid crystal display device 10 according to this embodiment generates the backlight data Xb based on the representative value for each pixel of the input video data, instead of generating the backlight data Xb separately for a plurality of pieces of color component data. Accordingly, an amount of calculation for obtaining brightness of the backlight 17 for each area is ¼ in the case of the liquid crystal display device including the field sequential processing unit 90 shown in FIG. 5, and ⅓ in the case of the image display device shown in FIG. 15. Therefore, according to the liquid crystal display device 10 of this embodiment, it is possible to reduce the amount of calculation for obtaining brightness of the backlight 17 for each area, and thus reduce a size of the circuit for obtaining brightness of the backlight 17 for each area.

As the representative value for each pixel, the representative value calculating unit 111 may obtain a maximum value of the plurality of pieces of color component data, or an average value of the plurality of pieces of color component data. In either case, it is possible to reduce a size of the circuit for obtaining brightness of the backlight 17 for each area.

Second Embodiment

Figure 6:
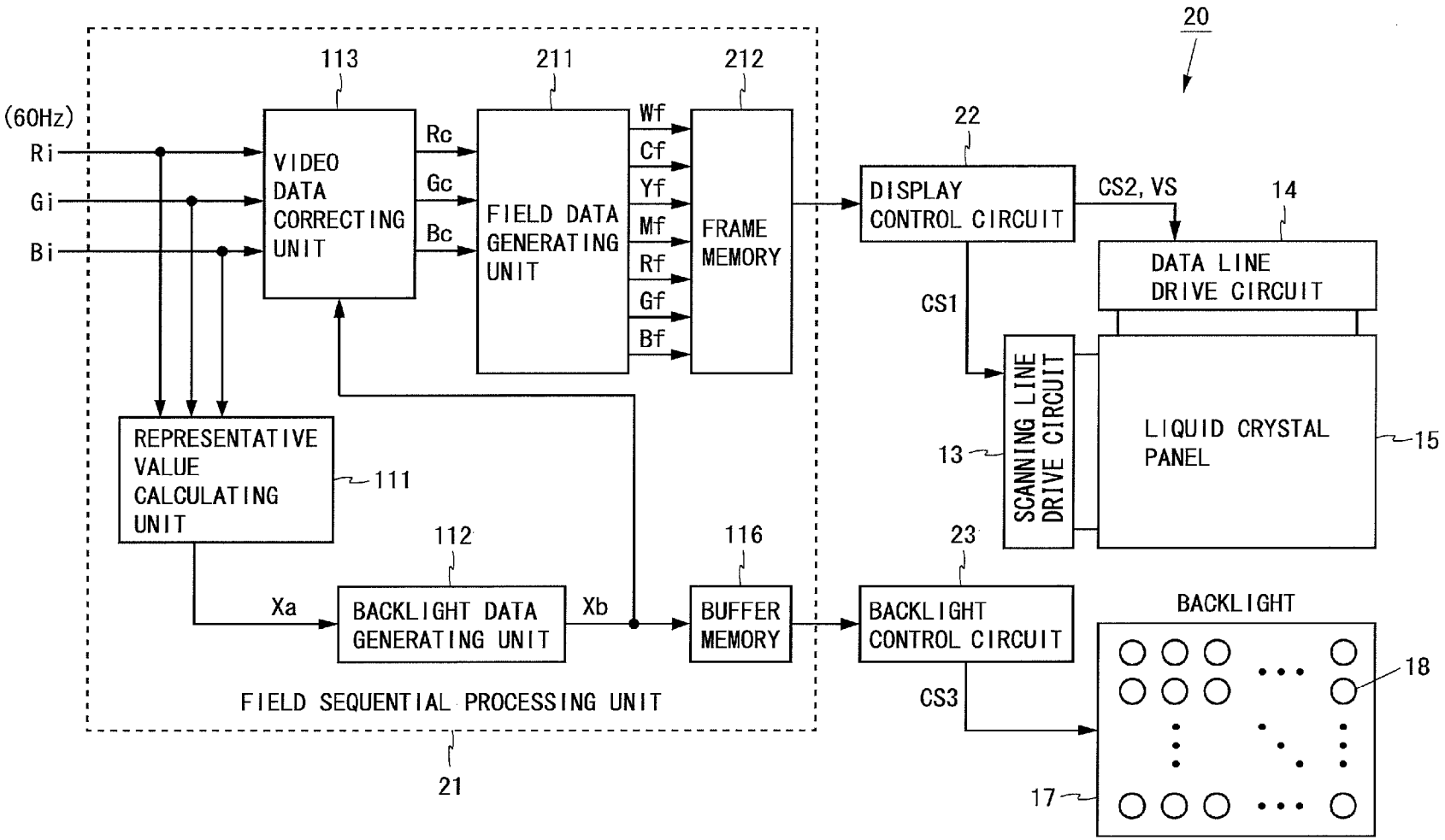
FIG. 6 is a block diagram illustrating a configuration of a liquid crystal display device according to a second embodiment of the present invention.

FIG. 6 is a block diagram illustrating a configuration of a liquid crystal display device according to a second embodiment of the present invention. A liquid crystal display device 20 shown in FIG. 6 includes a field sequential processing unit 21, a display control circuit 22, the scanning line drive circuit 13, the data line drive circuit 14, the liquid crystal panel 15, a backlight control circuit 23, and the backlight 17. The liquid crystal display device 20 displays seven fields (white, cyan, yellow, magenta, red, green, and blue fields) in one frame period by performing field sequential driving. In each of the following embodiments, the same components or components having the same function at different operation speeds as those described in a previously described embodiment are denoted by the same reference numerals, and descriptions for such components shall be omitted.

The field sequential processing unit 21 includes the representative value calculating unit 111, the backlight data generating unit 112, the video data correcting unit 113, afield data generating unit 211, a frame memory 212, and the buffer memory 116.

The field data generating unit 211 generates seven pieces of field data (white field data Wf, cyan field data Cf, yellow field data Yf, magenta field data Mf, red field data Rf, green field data Gf, and blue field data Bf) based on the three pieces of corrected video data Rc, Gc, and Bc output from the video data correcting unit 113. For example, the field data generating unit 211 performs calculation for each pixel of the liquid crystal panel 15 as shown by the following equations (5) to (11).

$$Wf=\min(Rc,Gc,Bc) \tag{5}$$

$$Cf=\min(Rc-Wf,Bc-Wf) \tag{6}$$

$$Yf=\min(Rc-Wf,Gc-Wf) \tag{7}$$

$$Mf=\min(Rc-Wf,Bc-Wf) \tag{8}$$

$$Rf=Rc-Wf-Yf-Mf \tag{9}$$

$$Gf=Gc-Wf-Cf-Yf \quad (10)$$

$$Bf=Bc-Wf-Cf-Mf \quad (11)$$

Figure 7A:
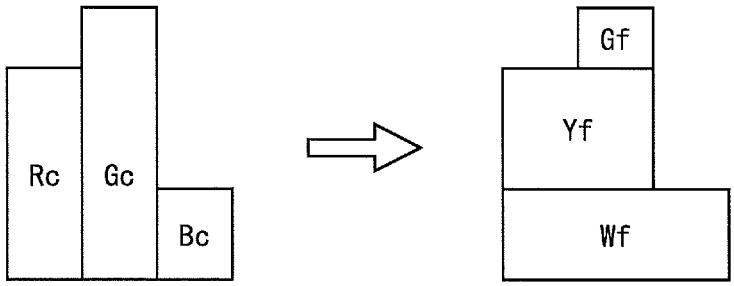
FIG. 7A is a diagram illustrating an example of processing by a field data generating unit of the liquid crystal display device shown in FIG. 6.
Figure 7B:
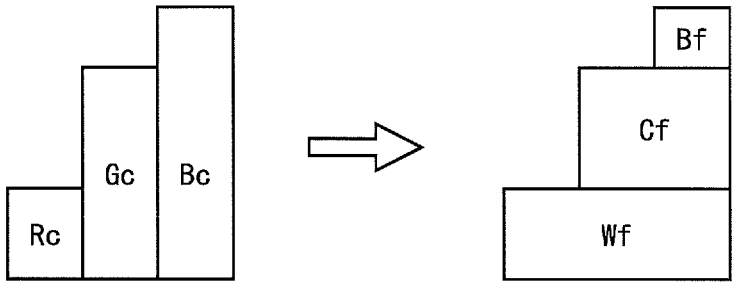
FIG. 7B is a diagram illustrating an example of processing by a field data generating unit of the liquid crystal display device shown in FIG. 6.
Figure 7C:
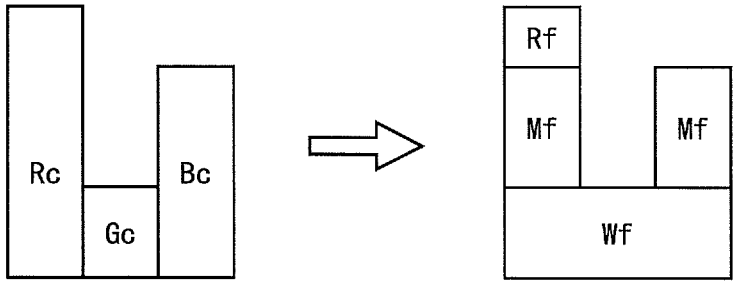
FIG. 7C is a diagram illustrating an example of processing by a field data generating unit of the liquid crystal display device shown in FIG. 6.

FIG. 7A to FIG. 7C are diagrams illustrating examples of processing by the field data generating unit 211. In the example shown in FIG. 7A, as a relation of Bc<Rc<Gc is established, Wf=Bc, Yf=Rc−Bc, Gf=Gc−Rc, Cf=Mf=Rf=Bf=0. In the example shown in FIG. 7B, as a relation of Rc<Gc<Bc is established, Wf=Rc, Cf=Gc−Rc, Bf=Bc−Gc, Yf=Mf=Rf=Gf=0. In the example shown in FIG. 7C, as a relation of Gc<Bc<Rc is established, Wf=Gc, Mf=Bc−Gc, Rf=Rc−Bc, Cf=Yf=Gf=Bf=0.

The seven pieces of field data Wf, Cf, Yf, Mf, Rf, Gf, and Bf generated by the field data generating unit 211 are stored in the frame memory 212. The display control circuit 22 sequentially reads the seven pieces of field data Wf, Cf, Yf, Mf, Rf, Gf, and Bf stored in the frame memory 212. The backlight control circuit 23 reads the backlight data Xb stored in the buffer memory 116. The liquid crystal panel 15 is driven based on the seven pieces of field data Wf, Cf, Yf, Mf, Rf, Gf, and Bf, and the backlight 17 is controlled based on the backlight data Xb.

Figure 8:
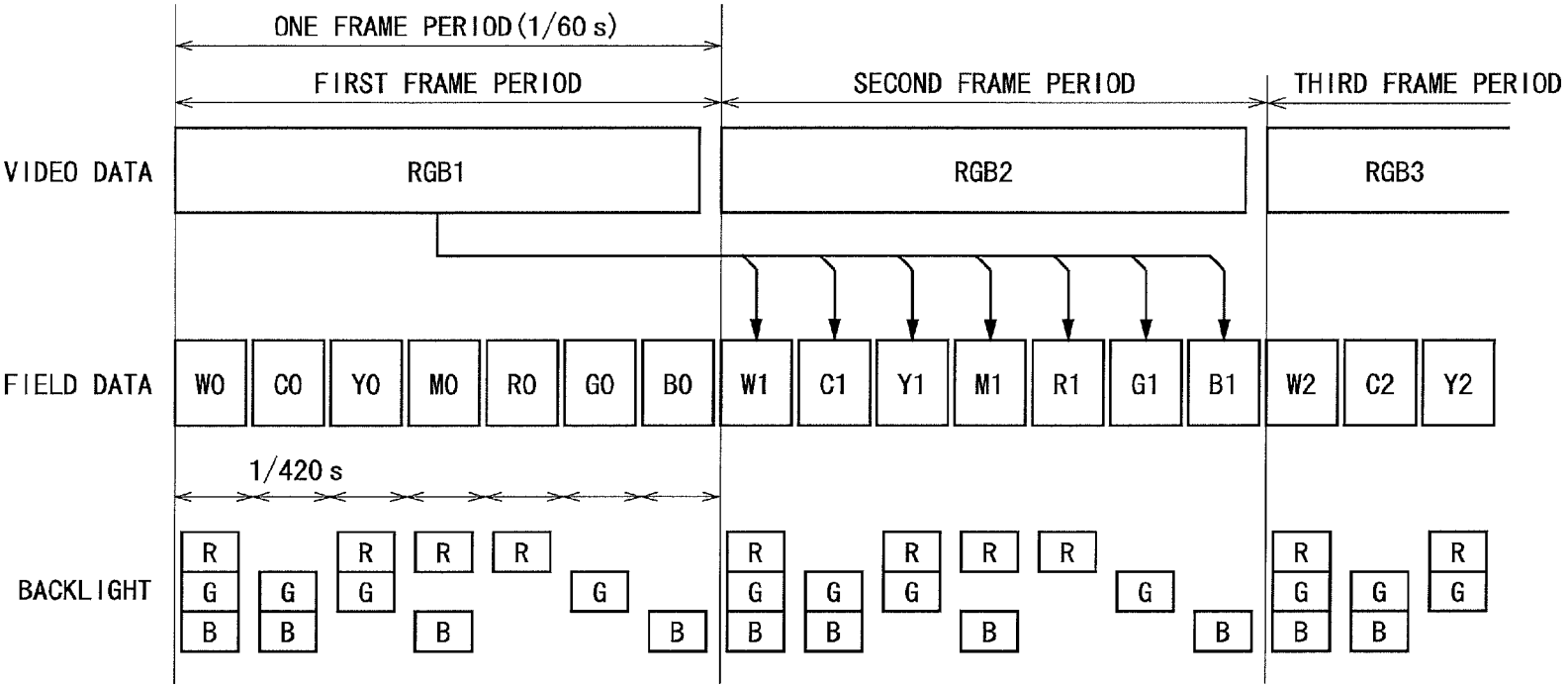
FIG. 8 is a timing chart of the liquid crystal display device shown in FIG. 6.

FIG. 8 is a timing chart of the liquid crystal display device 20. In the liquid crystal display device 20, one frame period is divided into seven field periods (field periods of white, cyan, yellow, magenta, red, green, and blue). In the first frame period, the video data RGB1 for the first frame is input to the liquid crystal display device 20. The field sequential processing unit 21 generates the backlight data X1 and the seven pieces of field data W1, C1, Y1, M1, R1, G1, and B1 based on the video data RGB1 for the first frame. The backlight data X1 is stored in the buffer memory 116, and the seven pieces of field data W1, C1, Y1, M1, R1, G1, and B1 are stored in the frame memory 212.

In the second frame period, the display control circuit 22 sequentially reads the seven pieces of field data W1, C1, Y1, M1, R1, G1, and B1 from the frame memory 212, and outputs the video signal VS including the pieces of read field data to the data line drive circuit 14. In the white, cyan, yellow, magenta, red, green, and blue field periods, the scanning line drive circuit 13 and the data line drive circuit 14 drive the liquid crystal panel 15 based on the white, cyan, yellow, magenta, red, green, and blue field data W1, C1, Y1, M1, R1, G1, and B1, respectively.

In the second frame period, the backlight control circuit 23 reads the backlight data X1 from the buffer memory 116. The backlight control circuit 23 controls the red, green, and blue LEDs to be in a light-emitting state in the white field period, controls the green and blue LEDs to be in the light-emitting state in the cyan field period, controls the red and green LEDs to be in the light-emitting state in the yellow field period, controls the red and blue LEDs to be in the light-emitting state in the magenta field period, and controls corresponding one of the red, green, and blue LEDs to be in the light-emitting state in each of the red, green, and blue field periods. In any of these field periods, the backlight control circuit 23 controls the LEDs 18 in each of the areas 19 to emit light with brightness corresponding to the backlight data X1.

According to the liquid crystal display device 20 of this embodiment, similarly to the first embodiment, the backlight data Xb is generated based on the representative value for each pixel of the input video data. Therefore, according to the liquid crystal display device 20, similarly to the first embodiment, it is possible to reduce a size of the circuit for obtaining brightness of the backlight 17 for each area. Further, according to the liquid crystal display device 20, by displaying the white, cyan, yellow, and magenta fields in addition to the red, green, and blue fields, it is possible to display each of red, green, and blue using four fields, and thus to reduce color breakup.

Figure 9:
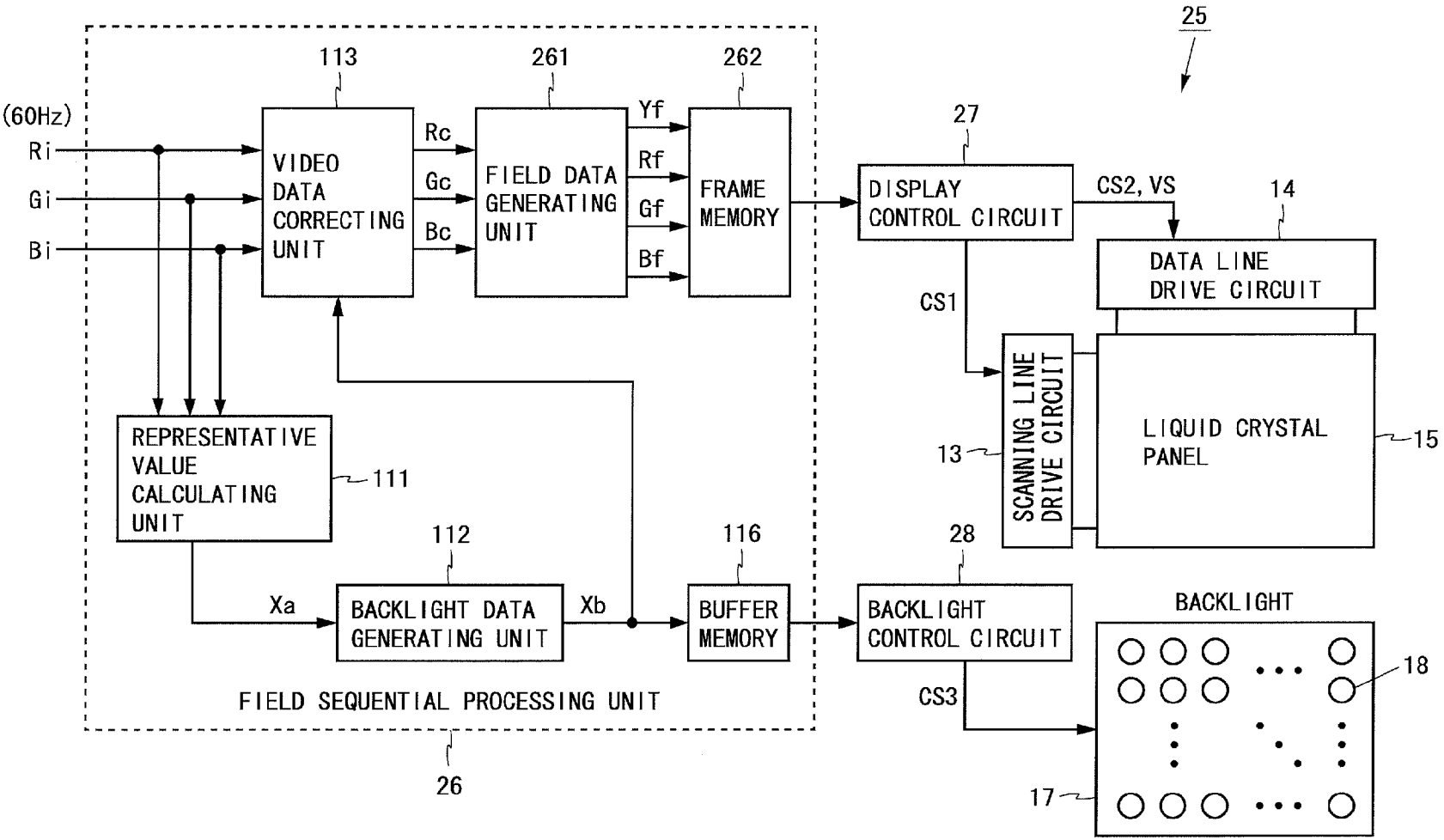
FIG. 9 is a block diagram illustrating a configuration of a liquid crystal display device according to a variation of the second embodiment of the present invention.

As a variation of the liquid crystal display device 20 according to this embodiment, it is possible to configure a liquid crystal display device that displays four to six fields in one frame period by performing field sequential driving. FIG. 9 is a block diagram illustrating a configuration of a liquid crystal display device that displays four fields (yellow, red, green, and blue fields) in one frame period.

In FIG. 9, a field data generating unit 261 generates four pieces of field data (yellow field data Yf, red field data Rf, green field data Gf, and blue field data Bf) based on the three pieces of corrected video data Rc, Gc, and Bc. For example, the field data generating unit 261 performs calculation for each pixel of the liquid crystal panel 15 as shown by the following equations (12) to (15).

$$Yf=\min(Rc,Gc) \quad (12)$$

$$Rf=Rc-Yf \quad (13)$$

$$Gf=Gc-Yf \quad (14)$$

$$Bf=Bc \quad (15)$$

A display control circuit 27 sequentially reads the four pieces of field data Yf, Rf, Gf, and Bf stored in a frame memory 262. In the yellow, red, green, and blue field periods, the scanning line drive circuit 13 and the data line drive circuit 14 drive the liquid crystal panel 15 respectively based on the pieces of yellow, red, green, and blue field data Y1, R1, G1, and B1. A backlight control circuit 28 reads the backlight data Xb stored in the buffer memory 116. The backlight control circuit 28 controls the red and green LEDs to be in a light-emitting state in the yellow field period, and controls the red, green, and blue LEDs to be in the light-emitting state in the red, green, and blue field periods.

In a liquid crystal display device 25, the backlight data Xb is also generated based on the representative value for each pixel of the input video data. Therefore, according to the liquid crystal display device 25, it is possible to reduce a size of the circuit for obtaining brightness of the backlight 17 for each area. Further, by displaying the yellow field in addition to the red, green, and blue fields, it is possible to display each of red and green using two fields, and thus to reduce color breakup.

Generally, a field data generating unit generates the red, green, and blue field data and the field data for one or more colors selected from white, cyan, yellow, and magenta based on the three pieces of corrected video data Rc, Gc, and Bc. According to the liquid crystal display device including such a field data generating unit, by displaying field(s) for one or more colors selected from white, cyan, yellow, and magenta in addition to the red, green, and blue fields, it is possible to display two or more colors out of red, green, and blue using a plurality of fields, and thus to reduce color breakup.

In particular, the field data generating unit may generate the red, green, and blue field data and the field data for one color selected from the cyan, yellow, and magenta based on the three pieces of corrected video data Rc, Gc, and Bc. According to the liquid crystal display device including such a field data generating unit, by displaying any of the cyan, yellow, and magenta fields in addition to the red, green, and blue fields, it is possible to display two or more colors out of red, green, and blue using two fields, and thus to reduce color breakup.

Third Embodiment

Figure 10:
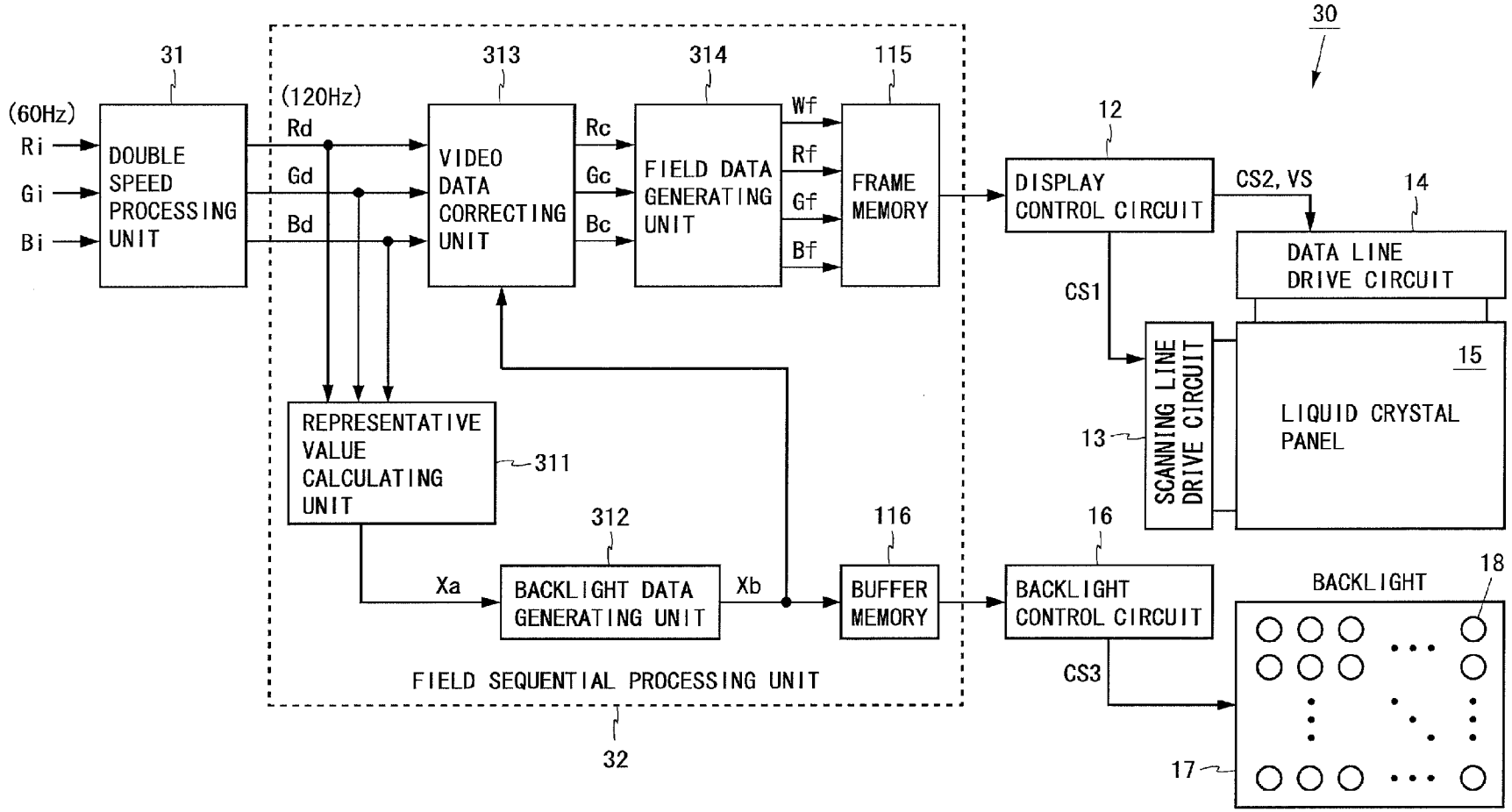
FIG. 10 is a block diagram illustrating a configuration of a liquid crystal display device according to a third embodiment of the present invention.

FIG. 10 is a block diagram illustrating a configuration of a liquid crystal display device according to a third embodiment of the present invention. A liquid crystal display device 30 shown in FIG. 10 includes a double speed processing unit 31, a field sequential processing unit 32, the display control circuit 12, the scanning line drive circuit 13, the data line drive circuit 14, the liquid crystal panel 15, the backlight control circuit 16, and the backlight 17. To the liquid crystal display device 30, input video data having a frame rate of 60 Hz is input from outside.

The double speed processing unit 31 is provided in a previous stage of the field sequential processing unit 32. The double speed processing unit 31 doubles the frame rate of input video data. For example, the double speed processing unit 31 performs interpolation processing to two successive frames, and inserts between the two frames an interpolation frame that has been obtained. The double speed processing unit 31 outputs double speed video data including red video data Rd, green video data Gd, and blue video data Bd, and having a frame rate of 120 Hz. Here, the double speed processing unit 31 is one example of a frame rate converting unit for converting a frame rate of the input video data.

The field sequential processing unit 32 includes a representative value calculating unit 311, a backlight data generating unit 312, a video data correcting unit 313, a field data generating unit 314, the frame memory 115, and the buffer memory 116. To the field sequential processing unit 32, the double speed video data output from the double speed processing unit 31 is supplied.

The representative value calculating unit 311 obtains a representative value for each pixel based on the double speed video data, and the backlight data generating unit 312 generates the backlight data Xb based on the representative value for each pixel. However, when double speed video data for two frames is supplied, the representative value calculating unit 311 obtains the representative value for each pixel based on the double speed video data for one frame, and the backlight data generating unit 312 generates the backlight data Xb based on the representative value for each pixel for one frame. Hereinafter, it is assumed that the representative value calculating unit 311 and the backlight data generating unit 312 perform the above-mentioned processing to double speed video data for an odd-numbered frame.

The video data correcting unit 313 corrects the red video data Rd, the green video data Gd, and the blue video data Bd based on the backlight data Xb. The video data correcting unit 313 corrects the double speed video data for an odd-numbered frame based on the backlight data Xb generated based on the odd-numbered frame, and corrects the double speed video data for an even-numbered frame based on the backlight data Xb generated based on an immediately previous odd-numbered frame. The field data generating unit 314 generates the four pieces of field data (white field data Wf, red field data Rf, green field data Gf, and blue field data Bf) based on the corrected double speed video data for two frames obtained by the video data correcting unit 313.

Figure 11:
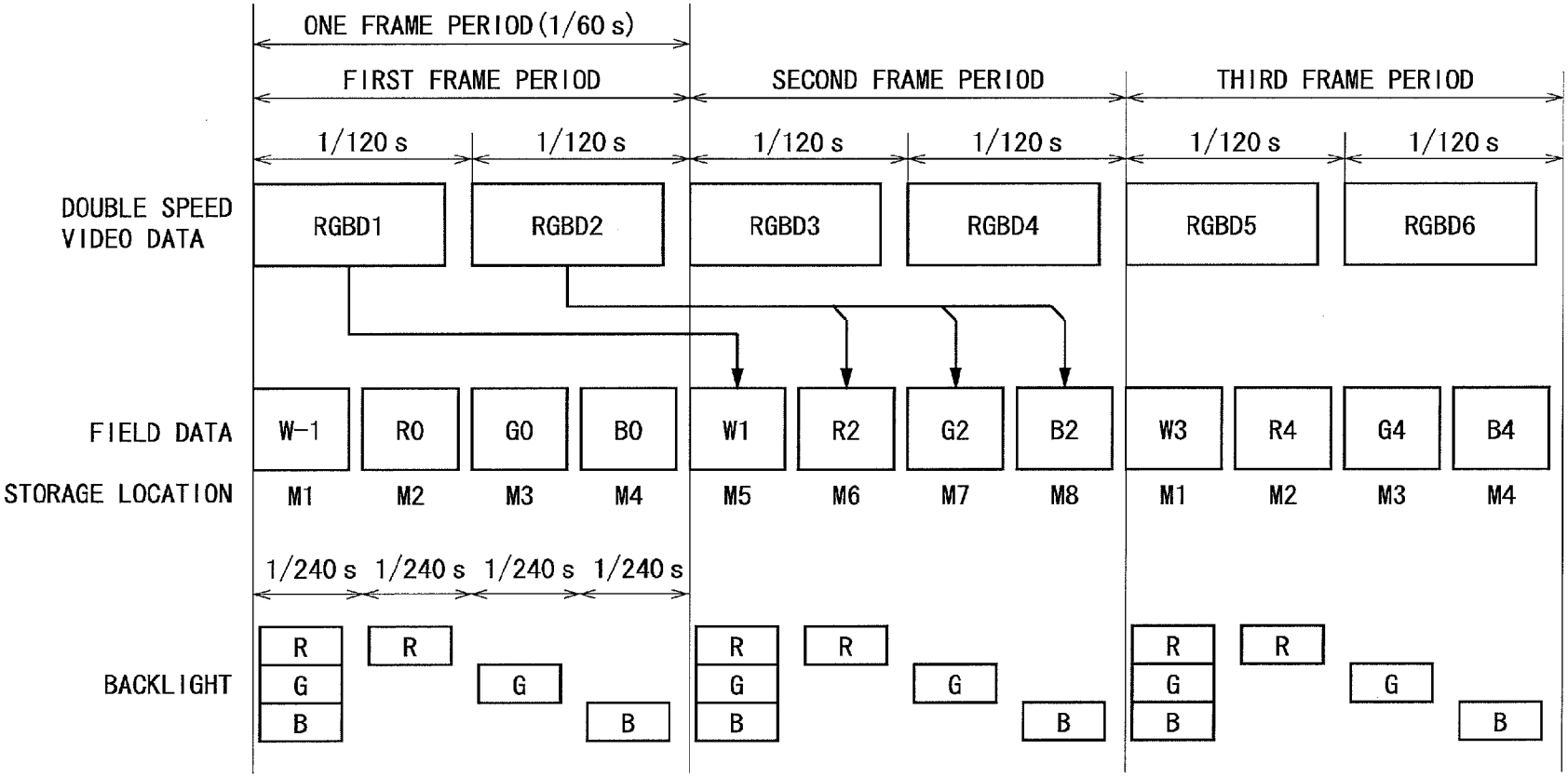
FIG. 11 is a timing chart of a first example of the liquid crystal display device shown in FIG. 10.

FIG. 11 is a timing chart of a first example of the liquid crystal display device 30. In this case, one frame period is divided into the white, red, green, and blue field periods, sequentially from the beginning. To the field sequential processing unit 32, the double speed processing unit 31 supplies double speed video data RGBD1 for a first frame in a first half of the first frame period, and double speed video data RGBD2 for a second frame in a latter half of the first frame period.

In the first half of the first frame period, the representative value calculating unit 311 obtains the representative value for each pixel based on the double speed video data RGBD1 for the first frame. The backlight data generating unit 312 generates the backlight data X1 based on the representative value for each pixel of the double speed video data RGBD1 for the first frame. The video data correcting unit 313 corrects the double speed video data RGBD1 for the first frame based on the backlight data X1. The field data generating unit 314 generates only the white field data W1 based on the corrected double speed video data for the first frame. The white field data W1 is stored in the frame memory 115.

In the latter half of the first frame period, the representative value calculating unit 311 and the backlight data generating unit 312 do not operate. The video data correcting unit 313 corrects the double speed video data RGBD2 for the second frame based on the previously generated backlight data X1. The field data generating unit 314 generates red field data R2, green field data G2, and blue field data B2 based on the corrected double speed video data for the second frame. White field data W2 generated at this time is discarded. The red field data R2, the green field data G2, and the blue field data B2 are stored in the frame memory 115. Note that, when generating the red field data R2, the green field data G2, and the blue field data B2, the field data generating unit 314 may use the previously generated white field data W1 instead of generating the white field data W2.

Figure 12:
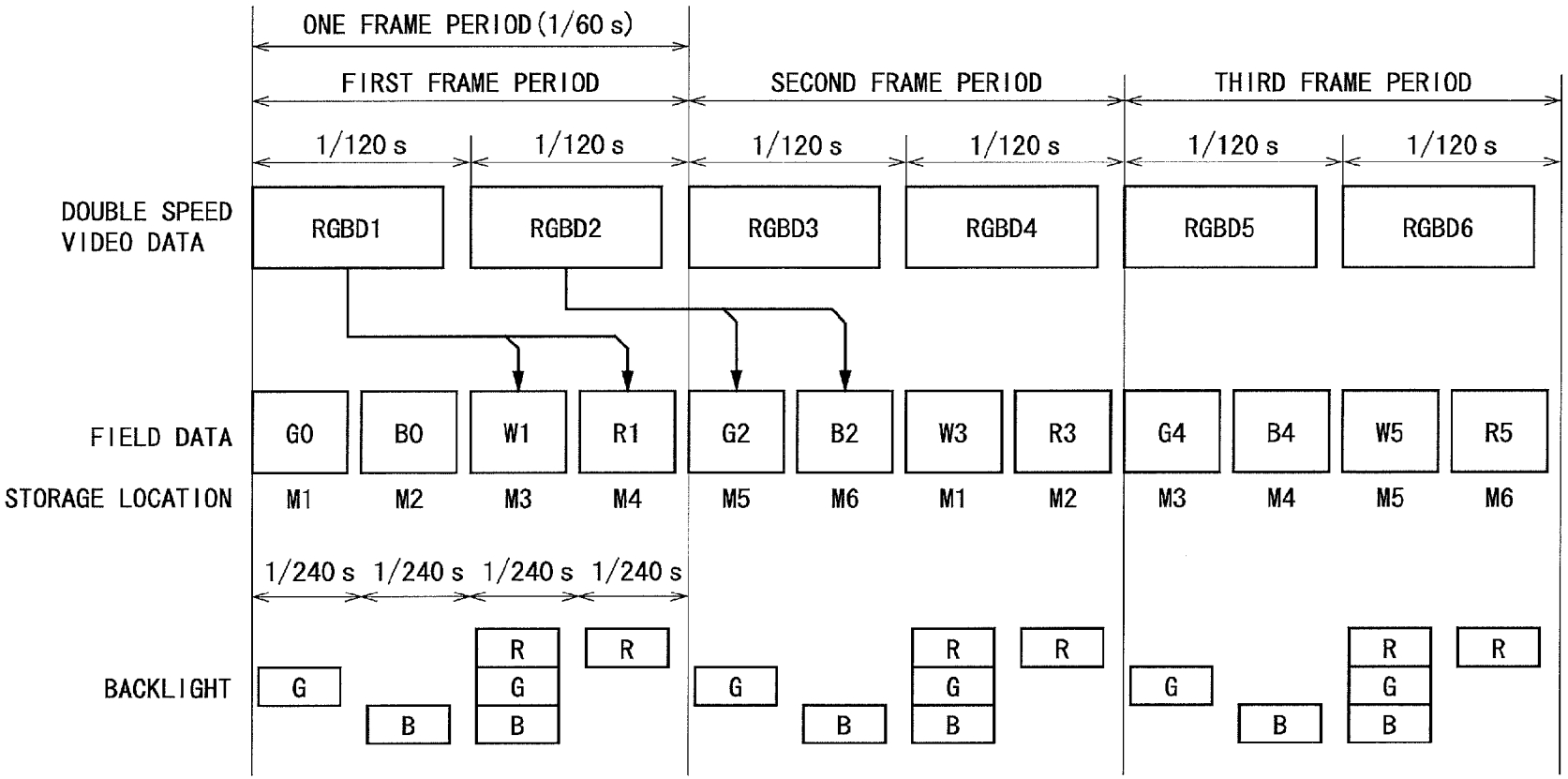
FIG. 12 is a timing chart of a second example of the liquid crystal display device shown in FIG. 10.

FIG. 12 is a timing chart of a second example of the liquid crystal display device 30. In this case, one frame period is divided into the green, blue, white, and red field periods, sequentially from the beginning. The representative value calculating unit 311, the backlight data generating unit 312, and the video data correcting unit 313 operate in a similar manner as in the first example. In the first half of the first frame period, the field data generating unit 314 generates the white field data W1 and the red field data R1 based on the corrected double speed video data for the first frame. In the latter half of the first frame period, the field data generating unit 314 generates the green field data G2 and the blue field data B2 based on the corrected double speed video data for the second frame.

FIG. 11 and FIG. 12 show storage locations of each field data in the frame memory 115. For example, in the first example, the white field data W1 is stored in a fifth area M5 of the frame memory 115, and the red field data R2 is stored in a sixth area M6 of the frame memory 115. In the first example, a memory that can store field data for eight frames is required as the frame memory 115. In the second example, a memory that can store field data for six frames is used as the frame memory 115. According to the second example, it is possible to reduce capacity of the frame memory 115 as compared to the first example.

Hereinafter, effects of the liquid crystal display device 30 according to this embodiment will be described. The liquid crystal display device 30 includes the double speed processing unit 31 that doubles the frame rate of the input video data. To the field sequential processing unit 32, the double speed video data output from the double speed processing unit 31 is supplied. Therefore, according to the liquid crystal display device 30, it is possible to reduce a size of the circuit for obtaining brightness of the backlight 17 for each area in a field sequential type liquid crystal display device that performs double speed processing to input video data and controls the brightness of the backlight according to the double speed video data.

Figure 13A:
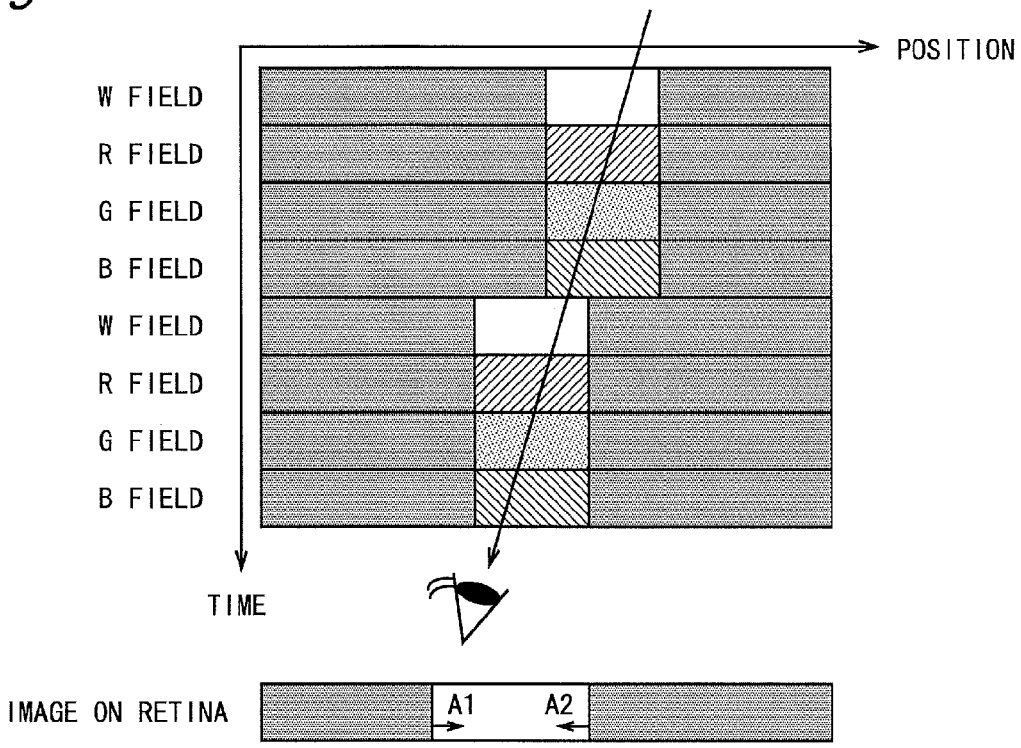
FIG. 13A is a diagram illustrating display positions in a liquid crystal display device not performing double speed processing and an image on a retina.

FIG. 13A is a diagram illustrating display positions in a liquid crystal display device not performing double speed processing and an image on a retina. With this liquid crystal display device, the display positions for the four fields are the same. Accordingly, when a line of sight of an observer moves following an object within a display screen, the observer often sees colors of the fields separated at edges A1 and A2 of the object. For example, the observer may possibly see the edge A1 in red, and the edge A2 in blue.

Figure 13B:
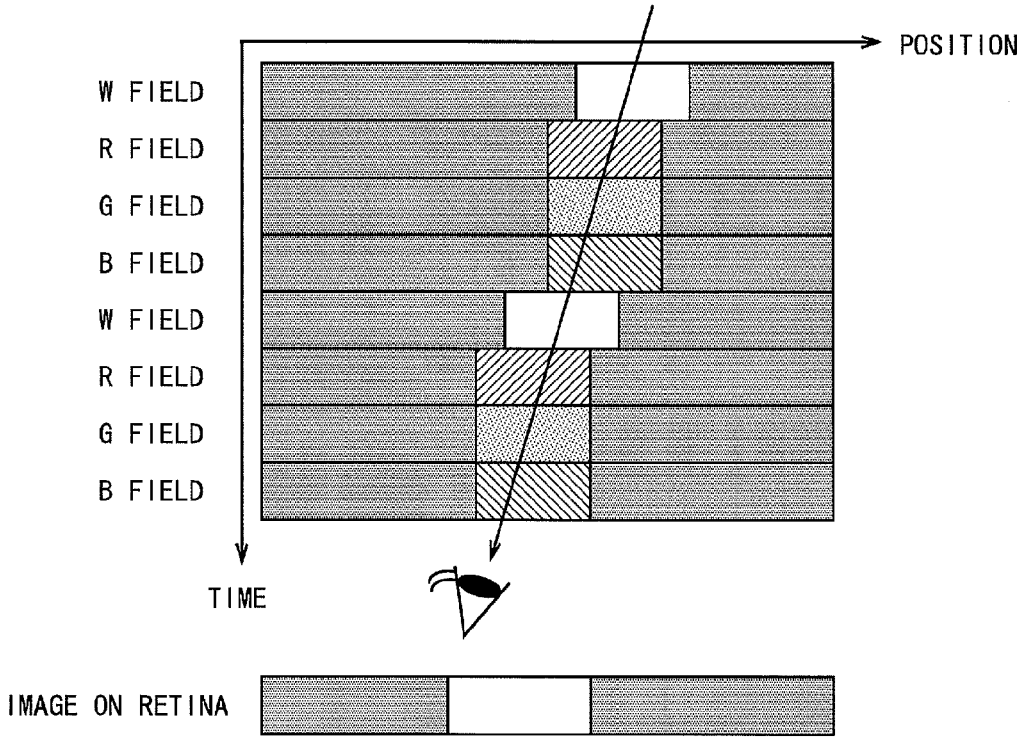
FIG. 13B is a diagram illustrating display positions in the liquid crystal display device shown in FIG. 10 and an image on a retina.

FIG. 13B is a diagram illustrating display positions in the liquid crystal display device 30 and an image on a retina. In the liquid crystal display device 30, the display position for the white field is displaced from the display positions for the red, green, and blue fields. Accordingly, even when the line of sight of the observer moves following an object within a display screen, it is less likely that the observer sees colors of the fields separated at edges A1 and A2 of the object. As described above, according to the liquid crystal display device 30, by performing double speed processing, which is one example of frame rate conversion processing, to the input video data, it is possible to correct the display positions in the fields, and to reduce color breakup.

Further, when the frame rate of the input video data is 60 Hz, if four fields are displayed in one frame period based on the double speed video data without any particular device, a drive frequency of liquid crystals becomes 480 Hz. Driving liquid crystals at a frame rate of 480 Hz is difficult, or may increase costs.

Thus, according to the field sequential processing unit 32 of the liquid crystal display device 30, when the double speed video data for two frames is supplied, the representative value calculating unit 311 obtains the representative value for each pixel based on the double speed video data for one frame, the backlight data generating unit 312 generates the backlight data Xb based on the representative value for one frame, the video data correcting unit 313 corrects the double speed video data for two frames based on the backlight data Xb, the field data generating unit 314 generates four pieces of field data corresponding to the one frame period based on the corrected video data for two frames obtained by the video data correcting unit 313. Therefore, in the liquid crystal display device 30, a drive frequency of liquid crystals is 240 Hz. Driving liquid crystals at a frame rate of 240 Hz is easy or may reduce costs as compared to the case in which liquid crystals are driven at a frame rate of 480 Hz.

In this manner, by displaying four fields corresponding to one frame period based on the double speed video data for two frames, as compared to the case in which four fields corresponding to one frame period based on the double speed video data for one frame are displayed, it is possible to lower a drive frequency of liquid crystals, and to configure the liquid crystal display device 30 more easily or at reduced costs. Further, by employing the double speed processing unit 31, a frame rate converting unit may be easily configured.

Fourth Embodiment

Figure 14:
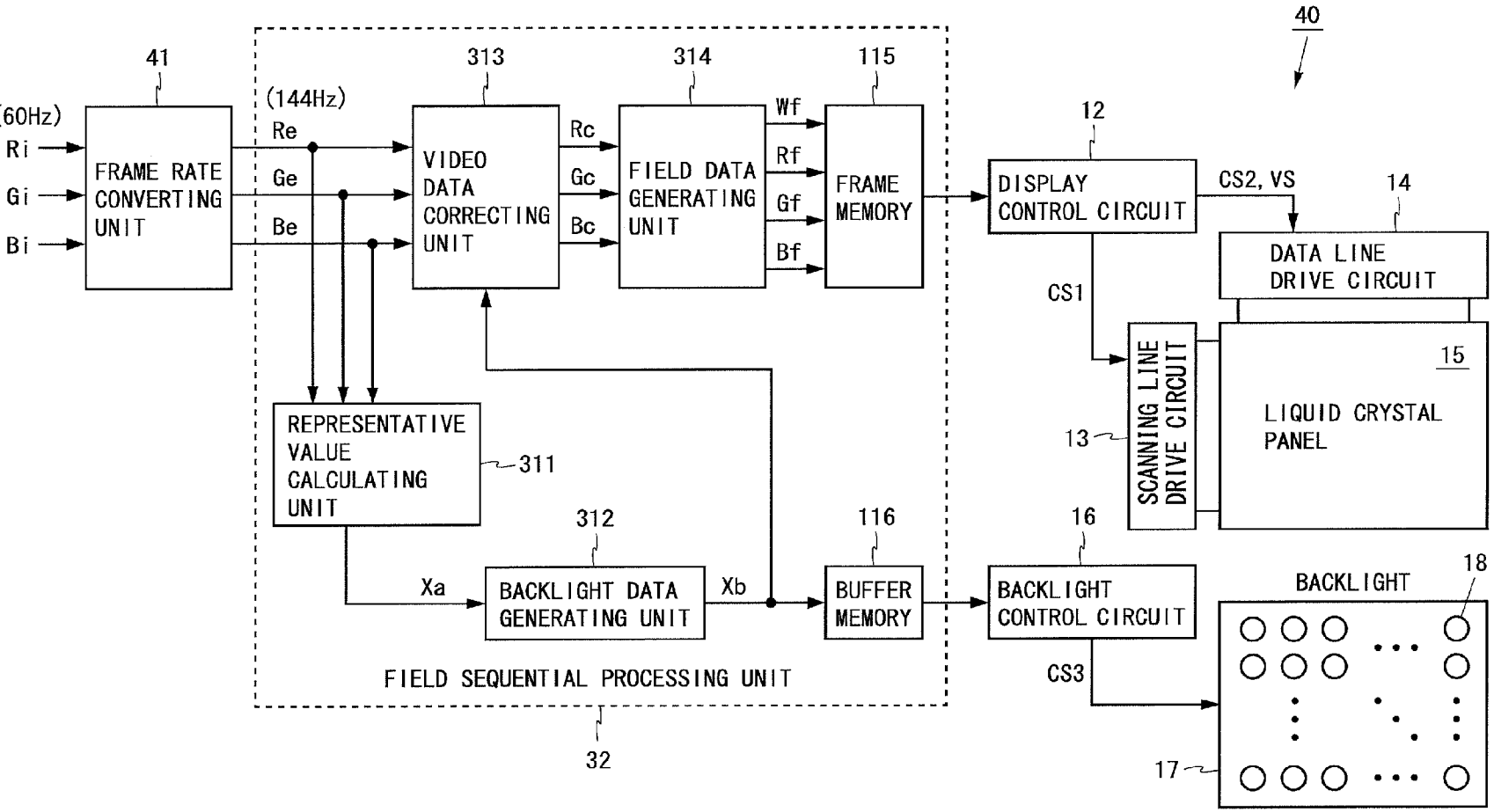
FIG. 14 is a block diagram illustrating a configuration of a liquid crystal display device according to a fourth embodiment of the present invention.

FIG. 14 is a block diagram illustrating a configuration of a liquid crystal display device 40 according to a fourth embodiment of the present invention. The liquid crystal display device 40 shown in FIG. 14 is configured such that the double speed processing unit 31 of the liquid crystal display device 30 according to the third embodiment is replaced by a frame rate converting unit 41. To the liquid crystal display device 40, input video data having a frame rate of 60 Hz is input from outside.

The frame rate converting unit 41 is provided in a previous stage of the field sequential processing unit 32. The frame rate converting unit 41 performs frame rate conversion processing to the input video data to increase the frame rate of the input video data from 60 Hz to 144 Hz. The frame rate converting unit 41 outputs video data after frame rate conversion that includes red video data Re, green video data Ge, and blue video data Be, and has a frame rate of 144 Hz. To the field sequential processing unit 32, the video data after frame rate conversion output from the frame rate converting unit 41 is supplied. The field sequential processing unit 32 operates in the same manner as in the third embodiment.

Hereinafter, effects of the liquid crystal display device 40 according to this embodiment will be described. The liquid crystal display device 40 includes the frame rate converting unit 41 that performs frame rate conversion processing to the input video data. To the field sequential processing unit 32, the video data after frame rate conversion output from the frame rate converting unit 41 is supplied. Therefore, according to the liquid crystal display device 40, in a field sequential type liquid crystal display device that controls the brightness of the backlight according to the video data after frame rate conversion, it is possible to reduce a size of the circuit for obtaining brightness of the backlight 17 for each area.

Further, according to the liquid crystal display device 40, similarly to the third embodiment, by performing frame rate conversion processing to the input video data, it is possible to correct the display positions in the fields, and to reduce color breakup. Moreover, by displaying four fields corresponding to one frame period based on the double speed video data for two frames, as compared to the case in which four fields corresponding to one frame period based on the double speed video data for one frame are displayed, it is possible to lower a drive frequency of liquid crystals, and to configure the liquid crystal display device 40 more easily or at reduced costs.

Furthermore, according to the liquid crystal display device 40, a frame rate of the display screen is 72 Hz, and a drive frequency of liquid crystals is 288 Hz. Generally, when a frame rate of a display screen is equal to or higher than 70 Hz, it is difficult for the observer to recognize flicker in the display screen. Further, as the drive frequency of liquid crystals is 288 Hz, it is possible to use a practical liquid crystal panel with reduced costs as the liquid crystal panel 15. Therefore, according to the liquid crystal display device 40, it is possible to reduce flicker from occurring in a display screen using a practical liquid crystal panel with reduced costs.

Note that the liquid crystal display device described above includes, as the backlight 17, a direct-type backlight having the plurality of LEDs 18 arranged two-dimensionally. Instead, the liquid crystal display device of the present invention may include, as the backlight 17, an edge-light type backlight having a plurality of LEDs arranged one-dimensionally and a light guide plate.

As described above, according to the liquid crystal display device of the present invention, in a field sequential type liquid crystal display device that controls brightness of a backlight according to video data, it is possible to reduce a size of a circuit for obtaining brightness of the backlight for each area, by generating backlight data based on the representative value for each pixel of the video data.

INDUSTRIAL APPLICABILITY

The liquid crystal display device of the present invention may be applied to display units of various electronic devices, as it is possible to reduce a size of a circuit for obtaining brightness of the backlight for each area.

DESCRIPTION OF REFERENCE CHARACTERS

10, 20, 25, 30, 40: LIQUID CRYSTAL DISPLAY DEVICE
11, 21, 26, 32: FIELD SEQUENTIAL PROCESSING UNIT
12, 22, 27: DISPLAY CONTROL CIRCUIT
13: SCANNING LINE DRIVE CIRCUIT
14: DATA LINE DRIVE CIRCUIT
15: LIQUID CRYSTAL PANEL
16, 23, 28: BACKLIGHT CONTROL CIRCUIT
17: BACKLIGHT
18: LED
19: AREA
111, 311: REPRESENTATIVE VALUE CALCULATING UNIT
112, 312: BACKLIGHT DATA GENERATING UNIT
113, 313: VIDEO DATA CORRECTING UNIT
114, 211, 261, 314: FIELD DATA GENERATING UNIT
115, 212, 262: FRAME MEMORY
116: BUFFER MEMORY
31: DOUBLE SPEED PROCESSING UNIT
41: FRAME RATE CONVERTING UNIT

The invention claimed is:

1. A field sequential type liquid crystal display device comprising:

a liquid crystal panel including a plurality of pixels arranged two-dimensionally;

a backlight including a plurality of types of light sources having different emission colors, each of the plurality of types of light sources including a plurality of light sources;

field sequential processing circuitry that generates, based on video data including a plurality of pieces of color component data, a plurality of pieces of field data used to drive the liquid crystal panel, and backlight data used to control the backlight;

panel drive circuity that drives the liquid crystal panel based on the field data corresponding to a color of a field in each field period;

backlight control circuity that controls, based on the backlight data, one or more types of light sources corresponding to the color of the field to be in a light-emitting state in each field period; and frame rate converting circuitry that performs frame rate conversion processing to input video data input from outside, wherein the field sequential processing circuitry includes:

representative value calculating circuitry that obtains a representative value for each pixel based on the video data;

backlight data generating circuitry that generates backlight data based on the representative value obtained by the representative value calculating circuitry, the backlight data indicating brightness of light sources in each of a plurality of areas obtained by dividing the backlight;

video data correcting circuitry that corrects the video data based on the backlight data; and field data generating circuitry that generates a plurality of pieces of field data based on the corrected video data obtained by the video data correcting circuitry, a number of the pieces of field data being greater than a number of the types of light sources, video data after conversion output from the frame rate converting circuitry is supplied as the video data to the field sequential processing circuitry, and when video data for two frames is supplied, the representative value calculating circuitry obtains the representative value for each pixel based on video data for one frame, the backlight data generating circuitry generates the backlight data based on the representative value for one frame, the video data correcting circuitry corrects the video data for two frames based on the backlight data, and the field data generating circuitry generates the plurality of pieces of field data based on the corrected video data for two frames obtained by the video data correcting circuitry.

2. The liquid crystal display device according to claim 1, wherein the representative value calculating circuitry obtains a maximum value of the plurality of pieces of color component data as the representative value for each pixel.

3. The liquid crystal display device according to claim 1, wherein the representative value calculating circuitry obtains an average value of the plurality of pieces of color component data as the representative value for each pixel.

4. The liquid crystal display device according to claim 1, wherein the backlight includes a plurality of red light sources, a plurality of green light sources, and a plurality of blue light sources, the video data includes red video data, green video data, and blue video data, and the field data generating circuitry generates pieces of red, green, and blue field data, and pieces of field data for one or more colors selected from white, cyan, yellow, and magenta, based on corrected red video data, corrected green video data, and corrected blue video data obtained by the video data correcting circuitry.

5. The liquid crystal display device according to claim 4, wherein the field data generating circuitry generates the white, red, green, and blue field data.

6. The liquid crystal display device according to claim 4, wherein the field data generating circuitry generates the white, cyan, yellow, magenta, red, green, and blue field data.

7. The liquid crystal display device according to claim 4, wherein the field data generating circuitry generates the red, green, and blue field data, and field data for one color selected from cyan, yellow, and magenta.

8. The liquid crystal display device according to claim 1, wherein the frame rate converting circuitry doubles a frame rate of the input video data.

9. The liquid crystal display device according to claim 1, wherein a frame rate of the input video data is 60 Hz, the frame rate converting circuitry converts the frame rate of the input video data to 144 Hz, and the field data generating circuitry generates four pieces of field data based on the corrected video data for two frames obtained by the video data correcting circuitry.

10. A method of driving a field sequential type liquid crystal display device including a liquid crystal panel having a plurality of pixels arranged two-dimensionally and a backlight including a plurality of types of light sources having different emission colors, each of the plurality of types of light sources including a plurality of light sources, the method comprising:

obtaining a representative value for each pixel based on the video data including a plurality of pieces of color component data;

obtaining backlight data based on the representative value, the backlight data indicating brightness of light sources in each of a plurality of areas obtained by dividing the backlight;

correcting the video data based on the backlight data;

generating a plurality of pieces of field data based on the corrected video data, a number of the pieces of field data being greater than a number of the types of light sources;

driving the liquid crystal panel based on the field data corresponding to a color of a field in each field period; and controlling, based on the backlight data, one or more types of light sources corresponding to the color of the field to be in a light-emitting state in each field period; and performing frame rate conversion processing to input video data input from outside and supplying video data after conversion as the video data, wherein when the video data for two frames is supplied, the representative value is obtained for each pixel based on the video data for one frame, the backlight data is generated based on the representative value for one frame, the video data for two frames is corrected based on the backlight data, and the plurality of pieces of field data is generated based on the corrected video data for two frames.

* * * * *